US009513603B2

(12) United States Patent
Hiranuma et al.

(10) Patent No.: US 9,513,603 B2
(45) Date of Patent: Dec. 6, 2016

(54) TIMEPIECE

(71) Applicant: Seiko Instruments Inc., Chiba-shi, Chiba (JP)

(72) Inventors: Haruki Hiranuma, Chiba (JP); Masahiro Ishida, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 14/847,444

(22) Filed: Sep. 8, 2015

(65) Prior Publication Data

US 2016/0070233 A1 Mar. 10, 2016

(30) Foreign Application Priority Data

Sep. 9, 2014 (JP) ..... 2014-183402

(51) Int. Cl.

| | |
|---|---|
| ***G04B 37/00*** | (2006.01) |
| ***G04B 29/00*** | (2006.01) |
| ***G04B 37/10*** | (2006.01) |
| ***G04B 3/04*** | (2006.01) |
| ***G04B 37/08*** | (2006.01) |

(52) U.S. Cl.

CPC ..... *G04B 37/106* (2013.01); *G04B 3/041* (2013.01); *G04B 37/081* (2013.01); *G04B 37/082* (2013.01); *G04B 37/10* (2013.01); *G04B 37/103* (2013.01)

(58) Field of Classification Search

CPC ..... G04B 37/081; G04B 37/082; G04B 37/10; G04B 37/103; G04B 37/106; G04B 3/041

USPC ..... 368/289–292, 306–308, 319

See application file for complete search history.

(56) References Cited

U.S. PATENT DOCUMENTS

| | | | | | |
|---|---|---|---|---|---|
| 3,064,415 | A * | 11/1962 | Polo | G04B 27/02 | 368/191 |
| 3,389,550 | A * | 6/1968 | Piquerez | G04B 19/28 | 368/308 |
| 3,535,869 | A * | 10/1970 | Strigini | G04B 37/103 | 368/289 |
| 3,783,607 | A * | 1/1974 | Feurer | G04B 19/30 | 368/290 |
| 4,104,866 | A * | 8/1978 | Chappatte | G04B 19/25 | 368/319 |
| 4,152,889 | A * | 5/1979 | Sekiguchi | G04B 37/106 | 368/290 |

(Continued)

FOREIGN PATENT DOCUMENTS

JP 2010-139399 A 6/2010

*Primary Examiner* — Amy Cohen Johnson
*Assistant Examiner* — Daniel Wicklund
(74) *Attorney, Agent, or Firm* — Brinks Gilson & Lione

(57) ABSTRACT

The present invention provides a timepiece which can lightly rotate an operation member to rotate an display body, while exhibiting a high level of waterproof performance around the operation member. One of the pipe and a shaft portion of the operation member inserted into the pipe has a first annular contact surface, and a second annular contact surface that have different diameters A packing capable of elastic deformation and configured to effect waterproofing between the pipe and the shaft portion is mounted. In operation, the packing is selectively brought into contact with the first and second contact surfaces such that the packing is pressed harder on one of the first and second contact surfaces than on the other.

7 Claims, 8 Drawing Sheets

(56) References Cited

U.S. PATENT DOCUMENTS

| | | | | |
|---|---|---|---|---|
| 4,408,901 | A * | 10/1983 | Gagnebin | G04B 37/062<br>368/319 |
| 8,454,227 | B2 * | 6/2013 | Romano | G04B 37/103<br>368/289 |
| 2002/0167866 | A1 * | 11/2002 | Oomori | G04B 37/06<br>368/191 |
| 2003/0174590 | A1 * | 9/2003 | Arikawa | G04C 3/001<br>368/319 |
| 2005/0162985 | A1 * | 7/2005 | Speichinger | G04B 3/041<br>368/319 |
| 2011/0051570 | A1 * | 3/2011 | Hiranuma | G04B 37/02<br>368/291 |
| 2011/0235477 | A1 * | 9/2011 | Hiranuma | G04B 37/02<br>368/291 |
| 2015/0023142 | A1 * | 1/2015 | Breuillot | G04B 37/103<br>368/290 |
| 2015/0117163 | A1 * | 4/2015 | Speichinger | G04B 3/041<br>368/185 |

* cited by examiner

TIMEPIECE

RELATED APPLICATIONS

This application claims priority under 35 U.S.C. §119 to Japanese Patent Application No. 2014-183402 filed on Sep. 9, 2014, the entire content of which is hereby incorporated by reference.

1. FIELD OF THE INVENTION

The present invention relates to a timepiece such as a portable timepiece containing within a case a display body moved through operation outside the case constituting the exterior member.

2. DESCRIPTION OF THE RELATED ART

Conventionally, there has been known a timepiece equipped with an in-revolving ring arranged so as to be rotatable around the peripheral edge of the dial in the exterior case, and an operation member rotating this ring from the outside of the exterior case (See, for example, JP-A-2010-139399 (Patent Literature 1)).

In the timepiece of Patent Literature 1, the operation member causing the in-revolving ring to rotate in conjunction therewith has a shaft portion extending through a pipe fixed to the exterior case, and a head portion for rotational operation continuous with this shaft portion and arranged outside the exterior case. The inner diameter of the pipe involves not variation but is fixed, and the outer diameter of the shaft portion involves no variation and is fixed. And, to secure waterproof property between the pipe and the shaft portion, a waterproof member such as a packing held in contact with the inner periphery of the pipe is mounted to the shaft portion.

On it back side, the in-revolving ring has teeth (drive gear) arranged in the peripheral direction, and a drive transmission gear in mesh with these teeth is provided on the shaft portion in the exterior case. Thus, with the drive transmission gear in mesh with the teeth of the in-revolving ring, the head portion of the operation member is rotated, whereby the in-revolving ring is rotated. As a result, it is possible to move the display of the in-revolving ring with respect to the dial and the time indicating hands.

No means in particular for retaining the in-revolving ring at an arbitrary rotational position is adopted. Thus, in the construction in which also other than during the operation of the operation member, the mesh-engagement between the drive transmission gear and the teeth of the in-revolving ring is maintained, the rotation of the operation member is suppressed by the frictional engagement force between the waterproof member and the pipe inner peripheral surface. As a result, it is possible to suppress inadvertent rotation of the in-revolving ring.

In this case, setting is made such that the interference of the waterproof member held between the pipe involving no change in inner diameter and the pipe involving no change in outer diameter is large (in other words, such that the degree of the elastic deformation of the waterproof member is increased), whereby it is possible to increase the frictional engagement force between this waterproof member and the pipe inner peripheral surface.

No special load is applied to the in-revolving ring, and this in-revolving ring is of much larger diameter as compared with the diameter of the drive gear. Thus, the requisite rotation amount of the rotation member for rotating the in-revolving ring by a predetermined angle, so that the operation member is high-rotation-operated by the user.

In this operation, when the frictional engagement force is strong, the rotational operation of the operation member becomes heavy. Moreover, with the rotation of the operation member, the outer periphery of the waterproof member slides on the inner peripheral surface of the pipe, so that the wear of this waterproof member is promoted. Thus, wear component (hereinafter referred to as wear refuse) is accumulated between the waterproof member and the pipe inner peripheral surface, so that there is a fear of deterioration in waterproof performance.

SUMMARY OF THE INVENTION

It is an object of the present invention to provide a timepiece which, although it can suppress a malfunction of the display body in the case, can lightly rotate the operation member causing the display body to operate in conjunction therewith, and which exhibits high level of reliability in waterproof performance around the operation member.

To achieve the above object, there is provided in accordance with the present invention a timepiece equipped with a case having a through-hole, a display body having a display and accommodated in the case so as to be capable of moving this display, a pipe fixed to the through-hole, an operation member having a head portion for rotating operation arranged outside the case, and a shaft portion inserted so as to be rotatable with respect to the pipe and so as to be movable in the axial direction of the pipe, and configured to move between an operating position where the display body is conjunction-operated through rotational operation of the head portion and a setting position where the display body is retained, and a ring-like packing held between the pipe and the shaft portion in an elastically deformed state and making the interface between the pipe and the shaft portion waterproof, wherein one of the pipe and the shaft portion has a first annular contact surface, a second annular contact surface having a diameter different from the diameter formed by the first annular contact surface, and an annular slope extending between the first and second annular contact surfaces; the other of the pipe and the shaft portion has an annular opposing surface opposite each of the above-mentioned surfaces; the packing protrudes from the annular opposing surface and is mounted to the other of the pipe and the shaft portion; and in the state in which the operation member is arranged at the operating position, the packing is brought into contact with that of the first and second annular contact surfaces exhibiting a wider gap between itself and the annular opposing surface, and, in the state in which the operation member is arranged at the setting position, the packing is brought into contact with the annular contact surface forming between itself and the annular opposing surface a gap narrower than the above-mentioned gap.

In the timepiece of the present invention, the head portion of the operation member is held outside the case and pushed and drawn, whereby the operation member is moved in the direction in which the shaft portion thereof extends between the operating position and the setting position, and, with this, the relative positions of the shaft portion and the pipe into which it is inserted are changed. As a result, the packing comes into contact with one of the first annular contact surface and the second annular contact surface, securing a waterproof condition for the interface between the pipe and the shaft portion of the operation member.

More specifically, when it is necessary to conjunction-move the display body, the operation member is arranged at the operating position. Due to this arrangement of the operation member, the first annular contact surface that one of the pipe and the shaft portion has and the annular opposing surface that the other of the pipe and the shaft portion has hold the packing protruding from the annular opposing surface in an elastically deformed state, thereby making the interface between the shaft portion and the pipe waterproof. When there is no need to conjunction-move the display body, the operation member is arranged at the setting position. Due to this arrangement of the operation member, the second annular contact surface that one of the pipe and the shaft portion has and the annular opposing surface that the other of the pipe and the shaft portion has hold the packing protruding from the annular opposing surface in an elastically deformed state, thereby making the interface between the shaft portion and the pipe waterproof.

The diameter that the first annular contact surface forms and the diameter that the second annular contact surface forms differ from each other; in the state in which the operation member is arranged at the operating position, the packing is brought into contact with that of the first and second annular contact surfaces which forms a wider gap between itself and the annular opposing surface, and the packing is increased in diameter so as to reduce the interference, thus securing a waterproof state around the operation member. In the state in which the operation member is arranged at the setting position, the packing is brought into contact with that of the first and second annular contact surfaces which forms a narrower gap between itself and the annular opposing surface, and the packing is increased in diameter so as to reduce the interference, thus securing a waterproof state around the operation member.

Thus, as compared with the packing at the operating position, at the setting position, the packing undergoes a stronger elastic deformation, and the degree of closeness in the contact between this packing and the annular contact surface is enhanced, so that it is possible to enhance the reliability in the waterproof property around the operation member. With this, as the degree of closeness is enhanced, the frictional engagement force between the packing and the annular contact surface in contact therewith increases. Due to the resistance based on this engagement force, the operation member is not easily inadvertently rotated. Thus, it is possible to suppress malfunction of the display body due to inadvertent rotation of the operation member while the timepiece is being carried about.

Conversely, as compared with the packing at the setting position, at the operating position, the packing undergoes weaker elastic deformation, and the degree of closeness in the contact of the packing with the annular contact surface decreases, so that the waterproofing around the operation member deteriorates within the range where the requisite performance is maintained. However, with the reduction in the degree of closeness, the resistance to the rotation of the operation member decreases as the frictional engagement force between the packing and the annular contact surface in contact therewith decreases. As a result, it is possible to lighten the rotational operation of the operation member when conjunction-operating the display body.

In this rotational operation, the packing slides on the annular contact surface of larger diameter; however, the degree of closeness of the packing with respect to the contact surface is reduced, so that the wear of packing with the sliding is suppressed. As a result, the packing is improved in terms of durability. At the same time, the wear refuse of the packing with the suppression of wear is reduced, and it is possible to suppress deterioration in the waterproof performance due to this refuse, so that, in this respect also, it is possible to enhance the reliability in the waterproofing around the operation member.

According to a preferred mode of the timepiece of the present invention, there is provided a timepiece, wherein the one consists of the pipe, and the first annular contact surface, the second annular contact surface, and the annular slope constitute at least a part of the inner peripheral surface of the pipe; and the diameter of the second annular contact surface is larger than the diameter of the first annular contact surface; and the other consists of the shaft portion, and the annular opposing surface constitutes at least a part of the outer peripheral surface of the shaft portion, with the packing being mounted to a mounting groove formed in the shaft portion.

According to this preferred mode, the annular slope continuous with the first annular contact surface and the second annular contact surface of a larger diameter than the diameter formed by the first annular contact surface are machined on the pipe, whereby it is possible to realize, without involving an increase in the number of components, a construction in which the interference of the packing is selectively changed through the movement of the operation member. Further, when machining the mounting groove to which the packing is mounted, the shaft portion does not restrict the operating space, and the space around the shaft portion constitutes the operating space. This results in satisfactory machinability, and there is no need to provide a special component for retaining the packing in the mounting of the packing.

According to a preferred mode of the timepiece of the present invention, there is provided a timepiece, wherein the first annular contact surface is provided on the inner side of the case with the annular slope serving as a boundary, and the second annular contact surface is provided on the outer side of the case with the annular slope serving as a boundary; and the inner diameter of the pipe that the first annular contact surface forms is smaller than the inner diameter of the pipe that the second annular contact surface forms, and the inner diameter of the pipe that the second annular contact surface forms is larger than the inner diameter of the pipe that the first annular contact surface forms.

According to this preferred mode, when the operation member is pulled toward the exterior of the case, the packing is increased in diameter so as to be increased in the interference thereof. And, in this state, the operation member is rotated. When the operation member in the pulled state is pushed in toward the interior of the case, the packing is reduced in diameter so as to be increased in the interference thereof. Through this movement of the operation member, it is possible to selectively change the interference of the packing.

According to a preferred mode of the timepiece of the present invention, there is provided a timepiece, wherein the first annular contact surface is provided on the outer side of the case with the annular slope serving as a boundary, and the second annular contact surface is provided on the inner side of the case with the annular slope serving as a boundary; and the inner diameter of the pipe that the first annular contact surface forms is smaller than the inner diameter of the pipe that the second annular contact surface forms, and the inner diameter of the pipe that the second annular contact surface forms is larger than the inner diameter of the pipe that the first annular contact surface forms.

According to this preferred mode, when the operation member is pushed in toward the interior of the case, the packing is increased in diameter so as to be reduced in its interference. And, in this state, the operation member is rotated. When the operation member is pulled toward the exterior of the case in this state, the packing is reduced in diameter so as to be increased in its interference. Through this movement of the operation member, it is possible to selectively change the interference of the packing.

According to a preferred mode of the timepiece of the present invention, there is provided a timepiece further including an urging member urging the operation member toward the exterior of the case.

According to this preferred mode, when there ceases to be the pushing-in force for the operation member pushed in to the operating position so as to be reduced in the interference of the packing, the operation member is automatically pushed back toward the exterior of the case by the urging force of the urging member. As a result, the operation member is restored to the setting position such that the interference of the packing increases, so that there is no need to perform an operation to restore the operation member to the setting position, making it possible to suppress inadvertent rotation of the operation member while, for example, the timepiece is being carried about.

According to a preferred mode of the timepiece of the present invention, there is provided a timepiece, wherein the one is the shaft portion, and the first annular contact surface, the second annular contact surface, and the annular slope constitute at least a part of the outer peripheral surface of the shaft portion, with the diameter formed by the second annular contact surface being larger than the diameter formed by the first annular contact surface; and the other is the pipe, and the annular opposing surface constitutes at least a part of the inner peripheral surface of the pipe, with the packing protruding from the inner peripheral surface of the pipe to be mounted to the pipe.

According to this preferred mode, the shaft portion of the operation member is provided with the annular slope continuous with the first annular contact surface and the second annular contact surface forming a larger diameter than that formed by the first annular contact surface, so that it is possible to realize, without involving the number of components, the construction in which the interference of the packing is selectively changed through the movement of the operation member.

According to a preferred mode of the timepiece of the present invention, there is provided a timepiece, wherein a disc-like dial is accommodated in the case, and the display body is ring-like, and is arranged so as to be rotatable along the outer peripheral edge of the dial.

According to this preferred mode, it is possible, as described above, to lightly rotate the operation member arranged at the operating position. At the same time, there is rotated the ring-like display body moved in conjunction with the operation member, so that it is possible to arbitrarily change the relationship between the display of the display body and the display of the dial or the time indicating hands. Further, as described above, the operation member arranged at the setting position is not inadvertently rotated, so that it is possible to suppress malfunction of the display body, and to suppress inadvertent disorder of a function determined by the relationship between the display of the display body and the display of the dial or the time indicating hands (e.g., timer function).

According to the present invention, although it is possible to suppress a malfunction of the display body in the case, it is possible to lightly rotate the operation member causing the display body to operate in conjunction therewith, and to achieve a high level of reliability in terms of waterproofing around the operation member.

DETAILED DESCRIPTION OF THE PREFERRED EMBODIMENTS

The first embodiment of the present invention will be described with reference to FIGS. 1 through 4.

Figure 1:
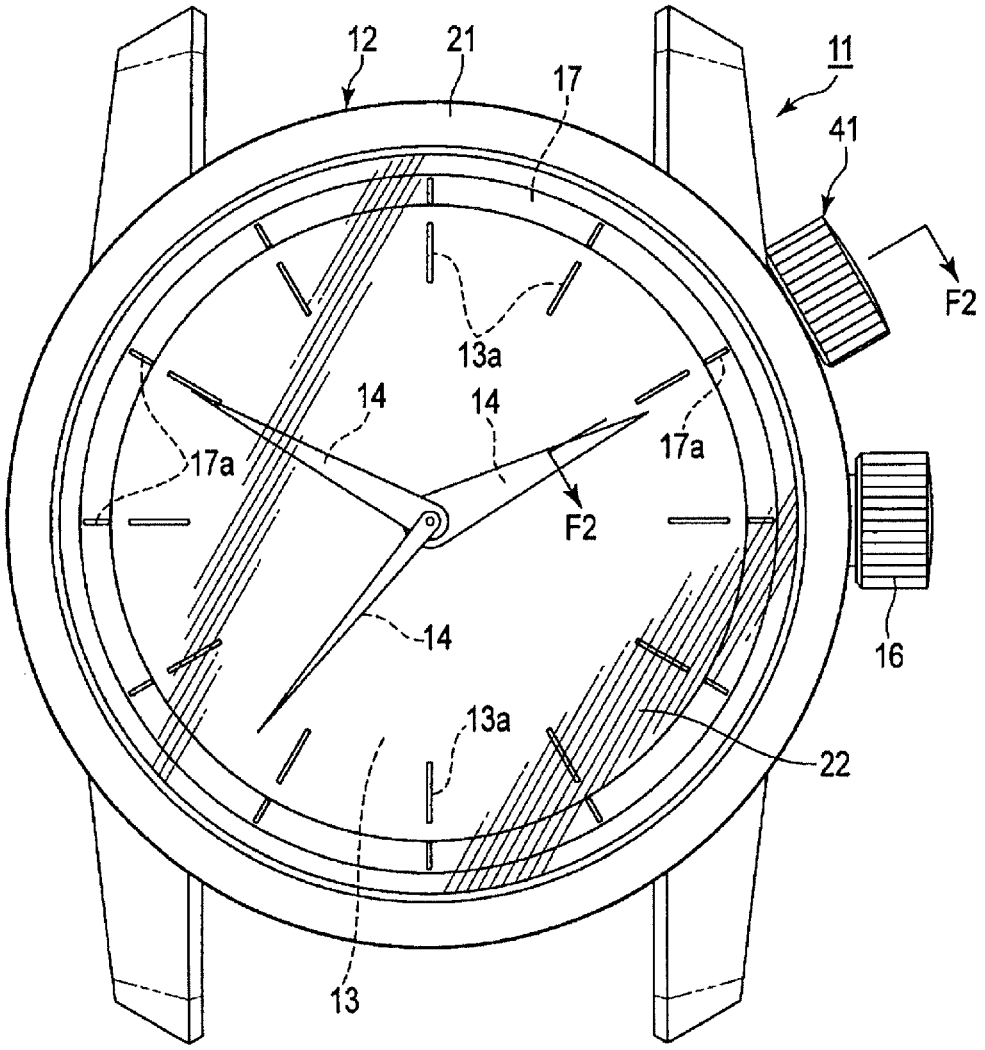
FIG. 1 is a front view of a wristwatch according to a first embodiment of the present invention.
Figure 2:
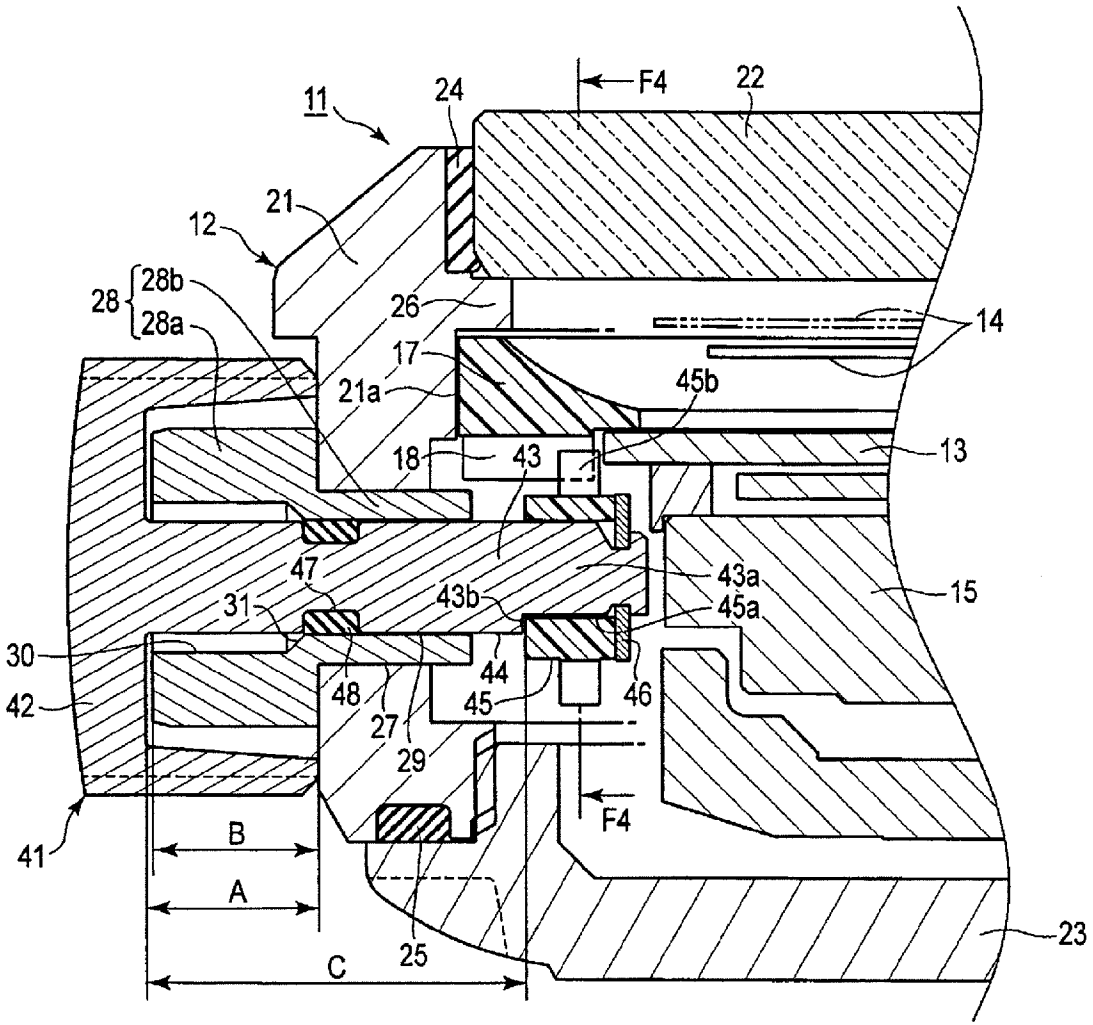
FIG. 2 is a sectional view taken along arrow line F2-F2 of FIG. 1.
Figure 3:
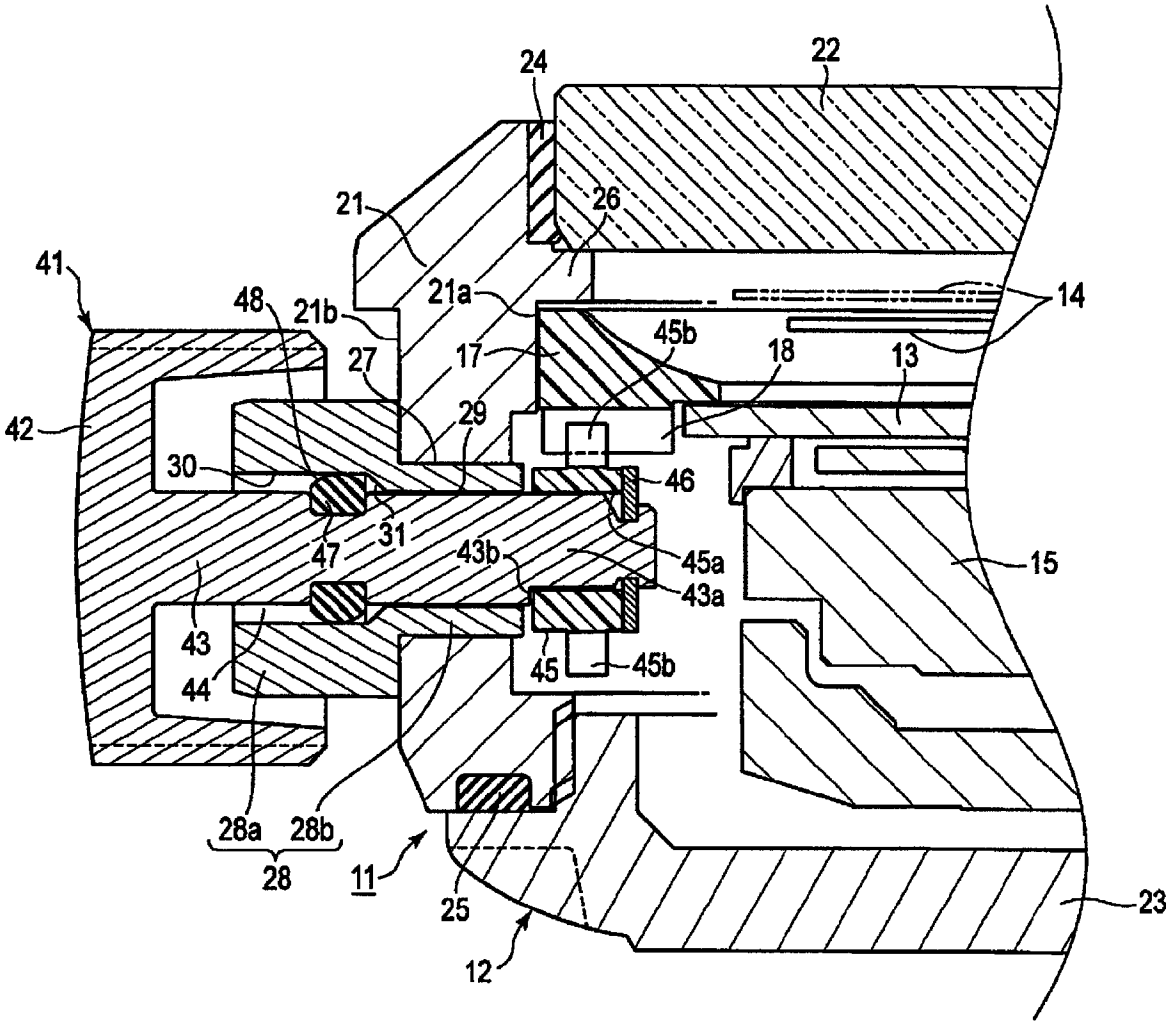
FIG. 3 is a sectional view corresponding to FIG. 2 showing a state in which the operation member of the wristwatch according to the first embodiment is arranged at the use position where it is operated.

In FIGS. 1 through 3, numeral 11 indicates a timepiece such as a portable timepiece, more specifically, a waterproof wristwatch. The wristwatch 11 is equipped with a case 12 constituting the exterior member thereof.

As shown in FIGS. 2 and 3, in the case 12, there are accommodated requisite members such as a dial 13, a movement 15 controlling the movement of the time display hands 14, and a display body 17.

The dial 13 is circular, and has in the peripheral portion a time indicating scale 13*a* shown in FIG. 1. The dial 13 may be a digital display type dial which displays the time display scale through a liquid crystal screen. Of a time hand, a minute hand, and a second hand, the time display hands 14 at least consist of the time hand and the minute hand.

As shown in FIG. 1, a crown 16 is mounted to the case 12 in the 3 o'clock direction of the wristwatch 11. The crown 16 is rotated outside the case 12. As a result, the rotation of the crown 16 is imparted to a train wheel (not shown) that the movement 15 has in order to rotate, e.g., the minute hand, and the position of the minute hand is adjusted.

The display body 17 is formed, for example, of synthetic resin, and is of a ring-like configuration in plan view as shown in FIG. 1. The outer diameter of the display body 17 is larger than the diameter of the dial 13, and the inner diameter of the display body 17 is smaller than the diameter of the dial 13. The display body 17 is arranged so as to be rotatable in the peripheral direction of the dial 13. As shown in FIGS. 2 and 3, the inner peripheral portion of the display body 17 overlaps the surface of the peripheral portion of the dial 13.

As shown in FIGS. 2 and 3, the thickness of the display body 17 increases gradually from the inner periphery toward the outer periphery. The inclined and annular surface of the display body 17 thereby formed is utilized as the display surface, and a display 17*a* is provided on this surface as shown in FIG. 1. The display 17*a* consists, for example, of graduations provided at equal intervals along the peripheral direction of the display body 17 by printing or the like. Through a change in the relative positions of the display 17*a* moved to a predetermined position through the rotation of the display body 17 and of the time indicating hands 14, it is possible to obtain a timer function by which a period of time that has elapsed since a predetermined time is measured.

As described above, it is desirable for the display body 17 to be of a ring-like configuration in plan view; this, however, should not be construed restrictively. In the case where the display body 17 is of a ring-like configuration in plan view, it may be of an endless configuration in plan view or of a C-shaped configuration, with its ends being opposite each other. The display 17*a* of the display body 17 is not restricted to graduations; it may also consist of a plurality of display regions divided by colors different from each other. Alternatively, the display 17*a* may consist of a plurality of plain display regions with symbols drawn therein (e.g., a sun symbol indicating the day time, and a moon symbol indicating the time after sunset). Further, instead of providing the timer function, the display 17*a* may be of a direction display enabling a simple direction measurement.

Figure 4:
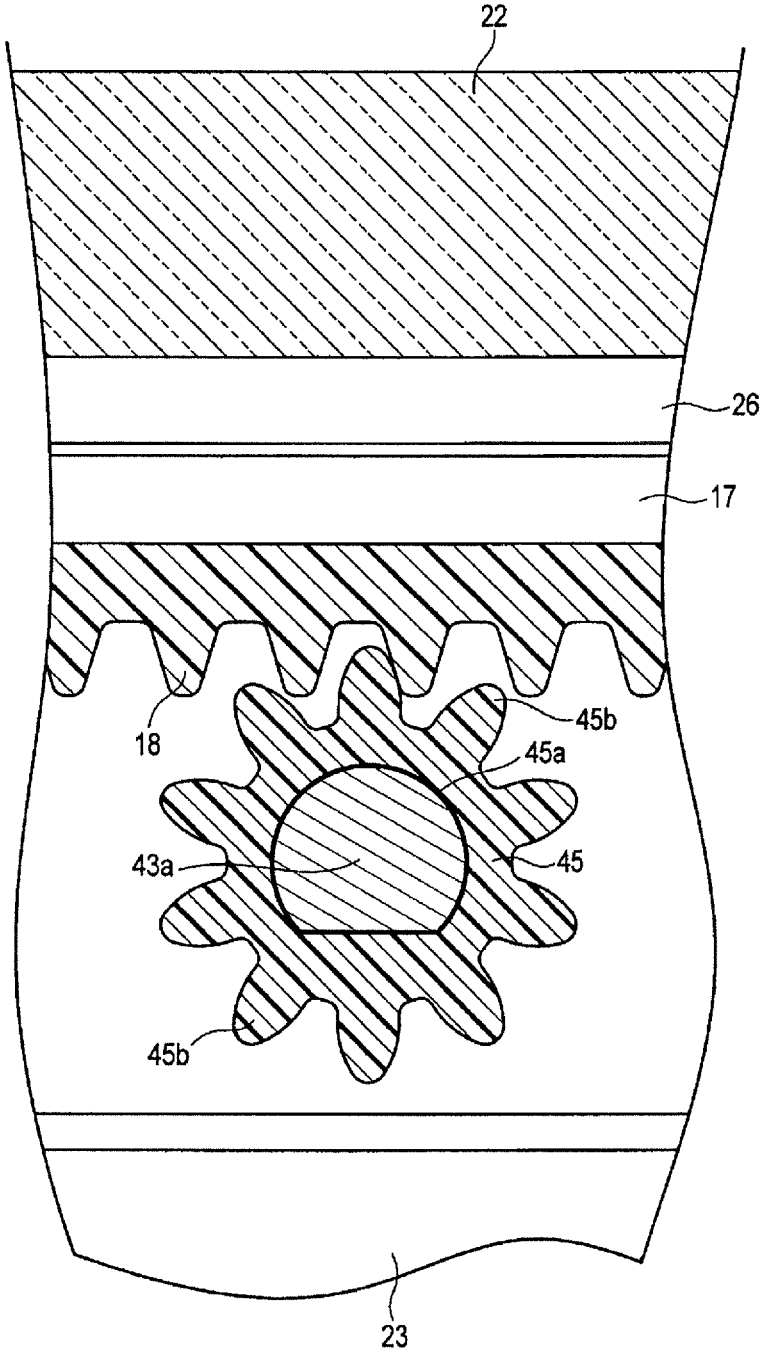
FIG. 4 is a sectional view taken along arrow line F4-F4 of FIG. 2.

As shown in FIGS. 2 through 4, the display body 17 integrally has on the back side thereof a driven gear portion 18. The driven gear portion 18 is provided with trough portions and crest portions arranged alternately in the peripheral direction of the display body 17, and the crest portions and the trough portions extend in the radial direction of the display body 17. The driven gear portion 18 is off the outer periphery of the dial 13, and surrounds this outer periphery.

As shown in FIGS. 2 and 3, the case 12 is formed by attaching, for example, a transparent cover 22 liquid-tight to one surface in the thickness direction of an annular case band 21 and attaching a case back 23 liquid-tight to the other surface in the thickness direction of the case band 21. It is desirable for the case band 21 to be formed of a metal such as stainless steel or titanium.

The transparent cover 22 is, for example, circular, and constitutes the front side of the timepiece 11. The transparent cover 22 consists of a transparent member, e.g., transparent glass; through this, it is possible to see the dial 13 and the display body 17. The case back 23 constitutes the back surface of the timepiece 11. The case back 23 is formed of metal, synthetic resin or the like. In FIGS. 2 and 3, numerals 24 and 25 respectively indicate annular seals held between the case band 21 and the transparent cover 22 and between the case band 21 and the case back 23 in order to maintain the liquid-tightness of the case 12.

As shown in FIGS. 2 and 3, the case band 21 has an annular protrusion 26 protruding toward the inner space. The back surface of the peripheral portion of the transparent cover 22 is held in contact with and supported by the annular protrusion 26. This annular protrusion 26 covers the surface of the outer peripheral portion of the display body 17. Thus, the display body 17 is retained by the dial 13 and the annular protrusion 26 so as not to move in the thickness direction of the timepiece 11. Further, the inner peripheral surface 21*a* of the case band 21 continuous at right angles with the back side of the annular protrusion 26 is close to the outer peripheral surface of the display body 17, whereby the display body 17 is retained so as not to move in the radial direction thereof.

The case band 21 has a through-hole 27 shown in FIGS. 2 and 3 at a position deviated from the mounting position of the crown 16, e.g., in the 2 o'clock direction. A pipe 28 is inserted into this through-hole 27 to be fixed to the case 12. When both the case band 21 and the pipe 28 are formed of metal, the pipe 28 is fixed to the case band 21 by brazing. When at least one of the case band 21 and the pipe 28 is formed of synthetic resin, the pipe 28 is fixed to the case band 21 by using adhesive. The pipe 28 extends in the radial direction of the display body 17.

The pipe 28 is in the form of a stepped cylinder having a large-diameter portion 28*a* and a small-diameter portion 28*b*. The small-diameter portion 28*b* of this pipe 28 is passed through the through-hole 27. The large-diameter portion 28*a* of the pipe 28 is arranged outside the case 12, with the end surface thereof nearer to the small-diameter portion 28*b* being held in contact with the outer peripheral surface of the case 12.

The inner peripheral surface of the pipe 28 has a first annular contact surface 29, a second annular contact surface 30 deviated in the axial direction of the pipe 28 with respect to the first annular contact surface 29, and an annular slope 31.

The diameter (inner diameter) of the first annular contact surface 29 is different from the diameter (inner diameter) of the second annular contact surface 30. More specifically, in the first embodiment, the diameter (inner diameter) of the second annular contact surface 30 is larger than the diameter (inner diameter) of the first annular contact surface 29; conversely, the diameter (inner diameter) of the first annular contact surface 29 is smaller than the diameter (inner diameter) of the second annular contact surface 30.

The annular slope 31 is provided so as to extend between the first annular contact surface 29 and the second annular contact surface 30. With this annular slope 31 serving as a boundary, the first annular contact surface 29 is provided on the inner side of the case 12, and the second annular contact surface 30 is provided on the outer side of the case 12. In the first embodiment, the first annular contact surface 29 constitutes the inner peripheral surface of the small-diameter portion 28*b* of the pipe 28, and the second annular contact surface 30 constitutes the inner peripheral surface of the large-diameter portion 28*a* of the pipe 28.

In the first embodiment, the first annular contact surface 29, the annular slope 31, and the second annular contact surface 30, which are continuous with each other, are formed to extend over the entire length of the pipe 28, that is, from one to the other longitudinal end thereof. This, however, should not be construed restrictively; each of the above surfaces may be formed so as to occupy a part in the axial direction of the pipe 28.

In FIG. 1, numeral 41 indicates an operation member. The operation member 41 is operated outside the case 12 in order to move the display 17*a*; it conjunction-moves the display body 17, and, the display body 17 is rotated through this conjunction movement. As shown in FIGS. 2 and 3, the operation member 41 is formed of metal, and is equipped with a head portion 42 and a shaft portion 43.

The head portion 42 is formed as a cap having a ring-like peripheral wall and an end wall closing one end of this peripheral wall. The depth A and inner diameter (the diameter formed by the inner peripheral surface of the peripheral wall) of this head 42 are larger than the entire length B of the large-diameter portion 28*a* of the pipe 28 and the diameter formed by the outer peripheral surface of the large-diameter portion 28*a*. A knurled portion for preventing slipping of the fingers of the operator when this head portion 42 is rotated is provided on the outer peripheral surface of the peripheral wall of the head portion 42 through knurling.

The shaft portion 43 integrally protrudes from the central portion of the back surface of the end wall of the head portion 42, and this shaft portion 43 is longer than the entire length of the large-diameter portion 28*a*. The sectional configuration of the distal end portion 43*a* of the shaft portion 43 in the direction orthogonal to the axial direction of the shaft portion 43 is non-circular, e.g., a D-shaped section as shown in FIG. 4. As a result, the shaft portion 43 has a step 43*b*.

The diameter of the outer peripheral surface of the portion other than the distal end portion 43*a*, that is, the diameter of the portion from the root of the shaft portion 43 to the distal end portion 43*a* having a length indicated by dimension C in FIG. 2 is fixed. The above-mentioned portion is longer than the entire length of the pipe 28, and the outer peripheral surface of this portion is used as an annular opposing surface 44. In the case where a drive gear 45 is superimposed, for example, on the distal end surface of the shaft portion 43 and is fixed thereto, it is possible to use the entire outer peripheral surface as the annular opposing surface 44.

The shaft portion 43 of the operation member 41 is rotatable with respect to the pipe 28 and is inserted so as to be movable in the axial direction of the pipe 28. As a result, the head portion 42 of the operation member 41 is arranged outside the case 12 while covering the large-diameter portion 28*a* of the pipe 28. At the same time, a narrow gap is formed between the first annular contact surface 29 and the annular opposing surface 44 by the pipe 28 and the shaft portion 43 inserted into the same, and a gap wider than this gap is formed between the first annular contact surface 29 and the annular opposing surface 44. In machining this surface, it is desirable for the diameter of the annular opposing surface 44 to be fixed; however, so long as the condition of securing the above gap relationship is satisfied, the diameter of the annular opposing surface 44 may be different with a packing mentioned below serving as a boundary.

Mounted to the distal end portion 43*a* of the shaft portion 43 of the operation member 41 is a drive gear 45 transmitting the rotation of the operation member 41 to the display body 17. More specifically, the drive gear 45 has a fit-engagement hole 45*a* of a configuration corresponding to the sectional configuration of the distal end portion 43*a*. After fit-engaging this fit-engagement hole 45*a* with the distal end portion 43*a*, there is mounted a snap ring 46 to a groove open in the outer peripheral surface of the distal end portion 43*a*, whereby the drive gear 45 is held between the snap ring 46 and the step 43*b*, and the distal end portion 43*a* is mounted so as to be prevented from rotating with respect to the distal end portion 43*a*. Teeth 45*b* that the drive gear 45 has are constantly kept in mesh with the driven gear portion 18 of the display body 17. That is, with the pushing and drawing operation of the operation member 41 described below, the position where the drive gear 45 and the driven gear portion 18 are in mesh with each other moves in the radial direction of the display body 17; the mesh-engagement itself, however, is maintained.

The shaft portion 43 has, in the intermediate portion in the longitudinal direction thereof, a peripherally continuous annular mounting groove 47. While fit-engaged with this mounting groove 47, a ring-like packing 48 is mounted so as to protrude from the outer peripheral surface (the annular opposing surface 44) of the shaft portion 43. The packing 48 is formed of a material capable of elastic deformation such as synthetic rubber or synthetic resin. This packing 48 is held between the pipe 28 and the shaft portion 43 inserted into the same while elastically deformed. As a result, the packing 48 makes the interface between the pipe 28 and the shaft portion 43 waterproof.

Through the pushing and drawing operation, the operation member 41 can be moved between an operating position and a setting position set so as to be deviated from each other in the axial direction of the pipe 28 along the axial direction of the pipe 28 extending in the radial direction of the display body 17. The operation member 41 pushed-in is arranged at the setting position shown in FIG. 2, and the operation member 41 drawn is arranged at the operating position shown in FIG. 3.

The setting position is a position for retaining the display body 17 so as to prevent it from being inadvertently rotated. With the operation member 41 being arranged at this setting position, the packing 48 is reduced in diameter and is brought into contact with the first annular contact surface 29 constituting the inner peripheral surface of the small-diameter portion 28*b* of the pipe 28. The frictional engagement force between the first annular contact surface 29 and the packing 48 is strong, whereby inadvertent rotation of the display body 17 and the operation member 41 is suppressed, making it possible to maintain the display body 17 in the still state.

The operating position is a position where the user or the like intentionally rotates the head portion of the operation member 41 to rotate the display body 17 in conjunction therewith. With the operation member 41 being arranged at this operating position, the packing 48 is increased in diameter and brought into contact with the second annular contact surface 30 constituting the inner peripheral surface of the large-diameter portion 28*a* of the pipe 28. The frictional engagement force between the second annular contact surface 30 and the packing 48 is weak, so that it is possible to lightly rotate the operation member 41.

Next, the procedures for rotating the display body 17 will be described.

First, in the state in which the packing 48 is in contact with the first annular contact surface 29 constituting the inner peripheral surface of the small-diameter portion 28*b* of the pipe 28 (shown in FIG. 2), the head portion 42 of the operation member 41 is pinched with fingers, and drawn toward the exterior of the case 12, and the operation member 41 is arranged at the operating position as shown in FIG. 3.

Through this movement of the operation member 41, the packing 48 gets out of the narrow gap between the shaft portion 43 and the small-diameter portion 28*b*, and gets into the wide gap between the shaft portion 43 and the large-diameter portion 28*a* to come into contact with the second annular contact surface 30. That is, as it gets out of the first annular contact surface 29, the packing 48 is increased in diameter, and comes into contact with the second annular contact surface 30 constituting the inner peripheral surface of the large-diameter portion 28*a* of the pipe 28. As a result, there is attained a state in which the interference of the packing 48 (in other words, the degree of elastic deformation of the packing 48) is small.

In this case, the resistance of the packing 48 to the movement of the operation member 41 is reduced through a reduction in the diameter of the packing 48. The difference in the sense of resistance is sensed by the fingers, whereby it is possible to know that the operation member 41 has been drawn to the operating position. Also in the state in which the operation member 41 is arranged at the operating position, the packing 48 maintains elastic deformation, so that the waterproof performance between the pipe 28 and the shaft portion 43 is secured.

In this state, the shaft portion 43 is rotated together with the head portion 42, whereby the drive gear 45 is rotated integrally with the shaft portion 43. With this, the rotation of the drive gear 45 is transmitted to the display body 17 via the mesh-engagement between the display body 17 and the driven gear portion 18. Thus, the display body 17 is rotated in conjunction with the rotation of the operation member 41, so that it is possible to move the display 17*a* thereof to a desired position.

As described above, in the state in which the operation member 41 is arranged at the operating position, the packing 48 is increased in diameter. As compared with the state in which the packing 48 is reduced in diameter as a result of coming into contact with the first annular contact surface 29 as shown in FIG. 2, the elastic deformation of the packing 48 in this state is weakened. As a result, the contact force between the packing 48 and the second annular contact surface 30 is low, and is smaller than the frictional engagement force therebetween. The frictional engagement force is a resistance to the rotation of the operation member 41. Thus, it is possible to lightly rotate the operation member 41 in the state in which it is arranged at the operating position.

The side surface of the drive gear 45 is opposite the distal end of the small-diameter portion 28*b* of the pipe 28. Thus, when the operation member 41 is threatened to be excessively pulled, the drive gear 45 gets caught by the distal end of the small-diameter portion 28*b*, and the pipe 28 serves as a stopper. As a result, the shaft portion 43 of the operation member 41 is drawn out of the pipe 28, and the operation member 41 is not detached from the case 12.

After the display body 17 has been rotated as desired, the operation member 41 is pushed in toward the interior of the case 12, and is moved from the use position to the setting position shown in FIG. 2. This pushing-in operation is stopped by the peripheral wall of the head portion 42 when it comes into contact with the outer side surface 21*b* of the case band 21.

Through the movement of the operation member 41, the packing 48 gets out of the wide gap between the shaft portion 43 and the large-diameter portion 28*a*, and gets into the narrow gap between the shaft portion 43 and the inner peripheral surface of the small-diameter portion 28*b* to come into contact with the first annular contact surface 29. That is, as it gets off the second annular contact surface 30, the packing 48 is reduced in diameter by the annular slope 31, and, in this state, comes into contact with the first annular contact surface 29 constituting the inner peripheral surface of the small-diameter portion 28*b* of the pipe 28. As a result, there is attained a state in which the interference of the packing 48 is large. Through the contact between the packing 48 and the first annular contact surface 29, the waterproof performance between the pipe 28 and the shaft portion 43 is secured.

As described above, in the state in which the operation member 41 is arranged at the setting position, the packing 48 is reduced in diameter. As compared with the state in which the packing 48 is held in contact with the second annular contact surface 30 to be increased in diameter as shown in FIG. 3, the elastic deformation of the packing 48 in this state is enhanced. As a result, the contact force between the packing 48 and the first annular contact surface 29 is strong, and is larger than the frictional engagement force therebetween. Thus, a high waterproof performance is secured between the pipe 28 and the shaft portion 43. At the same time, as a strong resistance force to the rotation of the operation member 41 is secured, it is possible to suppress the malfunction in which the operation member 41 is inadvertently rotated to rotate the display body 17.

The first annular contact surface 29 and the second annular contact surface 30 form no step but are continuous with each other via the annular slope 31 extending therebetween. As a result, the reduction in the diameter of the packing 48 accompanying the pushing-in of the operation member 41 is effected smoothly, and there is no fear of the packing 48 being scraped by the step to generate refuse. At the same time, due to the weak frictional engagement force between the second annular contact surface 30 and the packing 48 as described above, it is possible to reduce the wear of the packing 48 when rotating the display body 17. Thus, the durability of the packing 48 is improved.

Further, as described above, the packing 48 does not easily involve generation of cutting refuse and wear refuse. Thus, it is also possible to prevent deterioration in waterproofing property due to such refuse being got caught between the pipe 28 and the packing 48.

As described above, according to the first embodiment, it is possible to provide a wristwatch 11 which can lightly operate the operation member 41 conjunction-moving the display body 17 and which is of high reliability in waterproofing property around the operation member 41 although it can suppress a malfunction of the display body 17 in the case 12.

Further, in the first embodiment, in pushing and drawing the operation member 41 to selectively change the interference of the packing 48, it is possible to operate the operation member 41 in the same manner as the crown 16, which is desirable. Further, when the operation member 41 is pushed in, the interference of the packing 48 is large as described above. As a result, when the operation member 41 is inadvertently depressed while, for example, the timepiece 11 is being carried about, it is possible to maintain a state in which the interference of the packing 48 is large, so that the timepiece is of high reliability in terms of suppression of inadvertent rotation of the operation member.

Moreover, there are machined on the pipe 28 the annular slope 31 continuous with the first annular contact surface 29, and the second annular contact surface 30 exhibiting a diameter larger than the diameter formed by the first annular contact surface 29, whereby it is possible to realize, without involving an increase in the number of components, a construction in which the interference of the packing 48 is selectively changed through moving operation of the operation member 41. Further, when machining the mounting groove 47 to which the packing 48 is mounted, the shaft portion 43 does not restrict the operating space, and the space around the shaft portion constitutes the operation space, resulting in satisfactory machinability; further, there is no need to provide a special component for retaining the packing 48 when mounting the packing 48.

Figure 5:
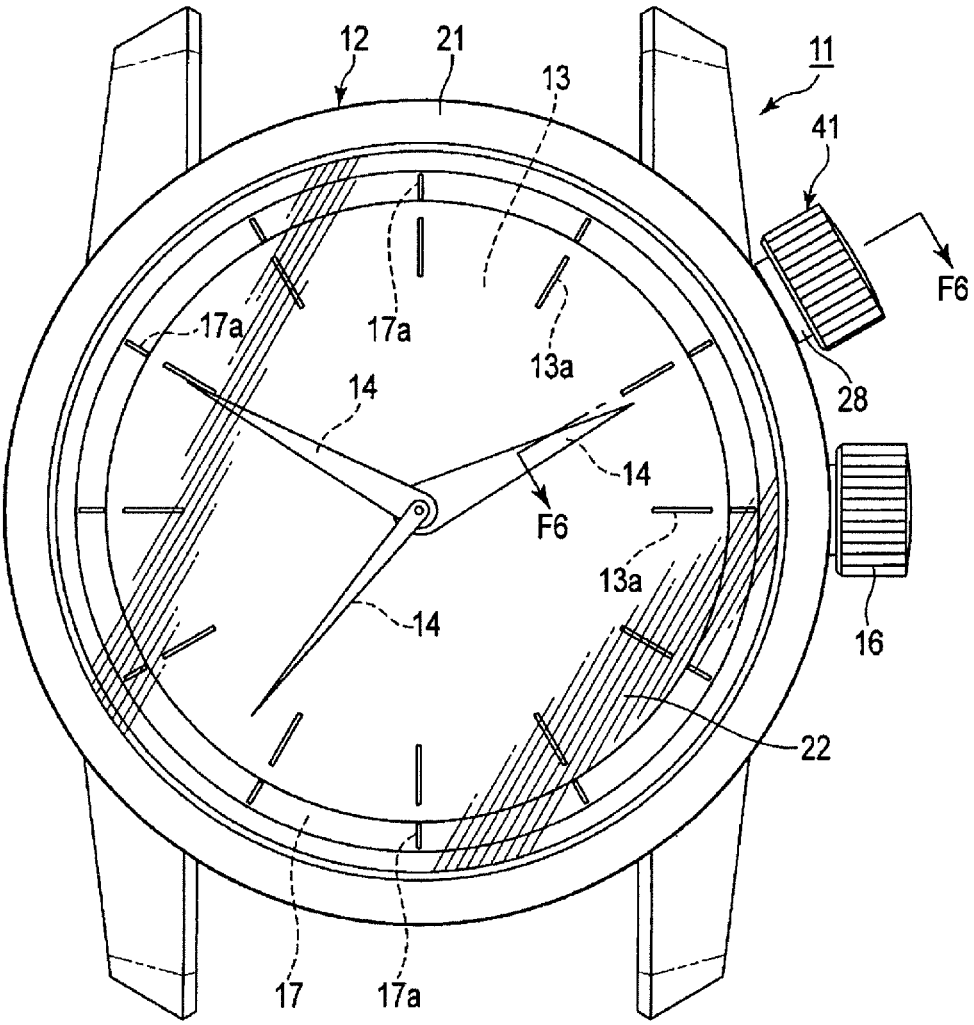
FIG. 5 is a front view of a wristwatch according to a second embodiment of the present invention.
Figure 6:
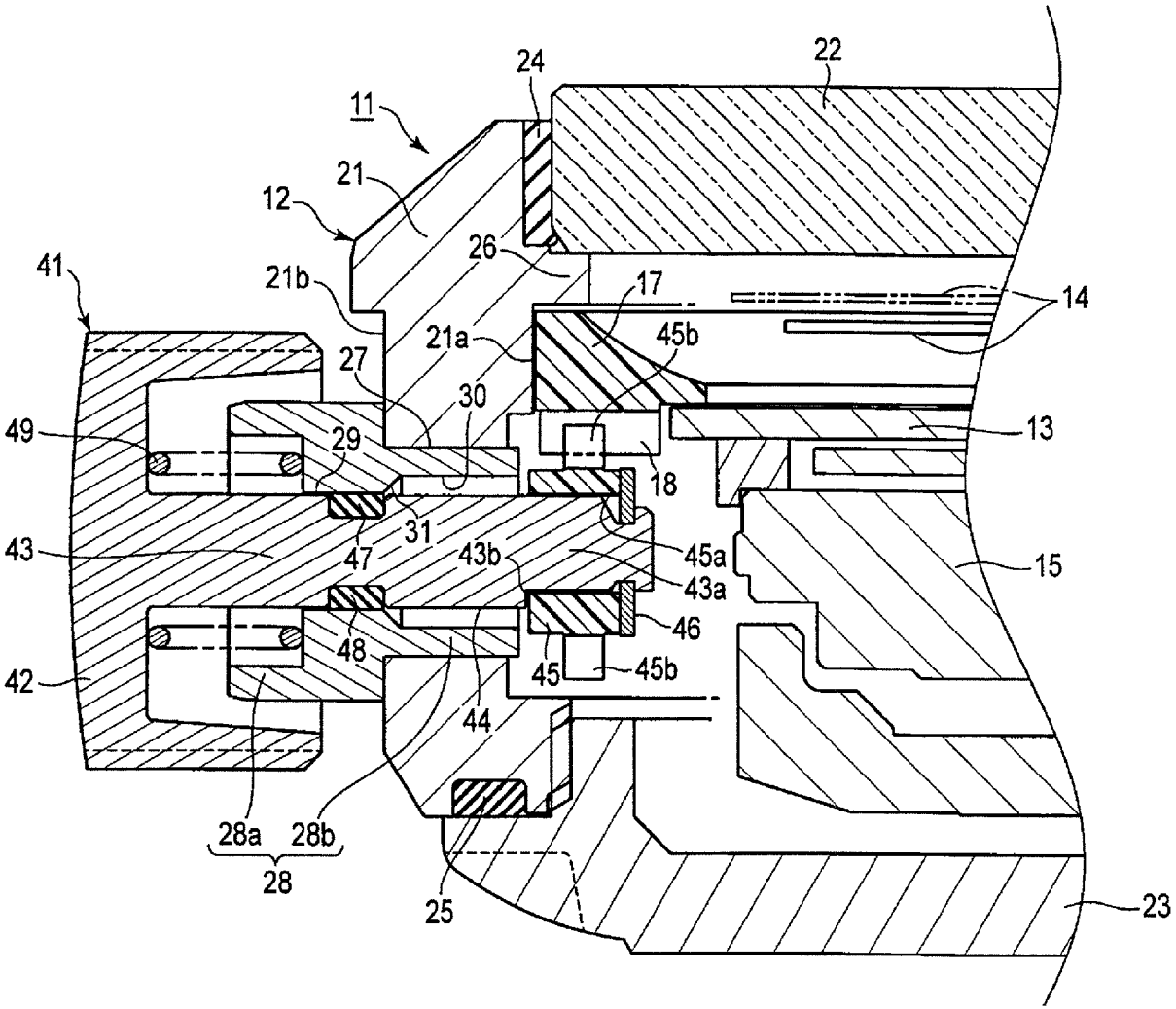
FIG. 6 is a sectional view taken along arrow line F6-F6 of FIG. 5.
Figure 7:
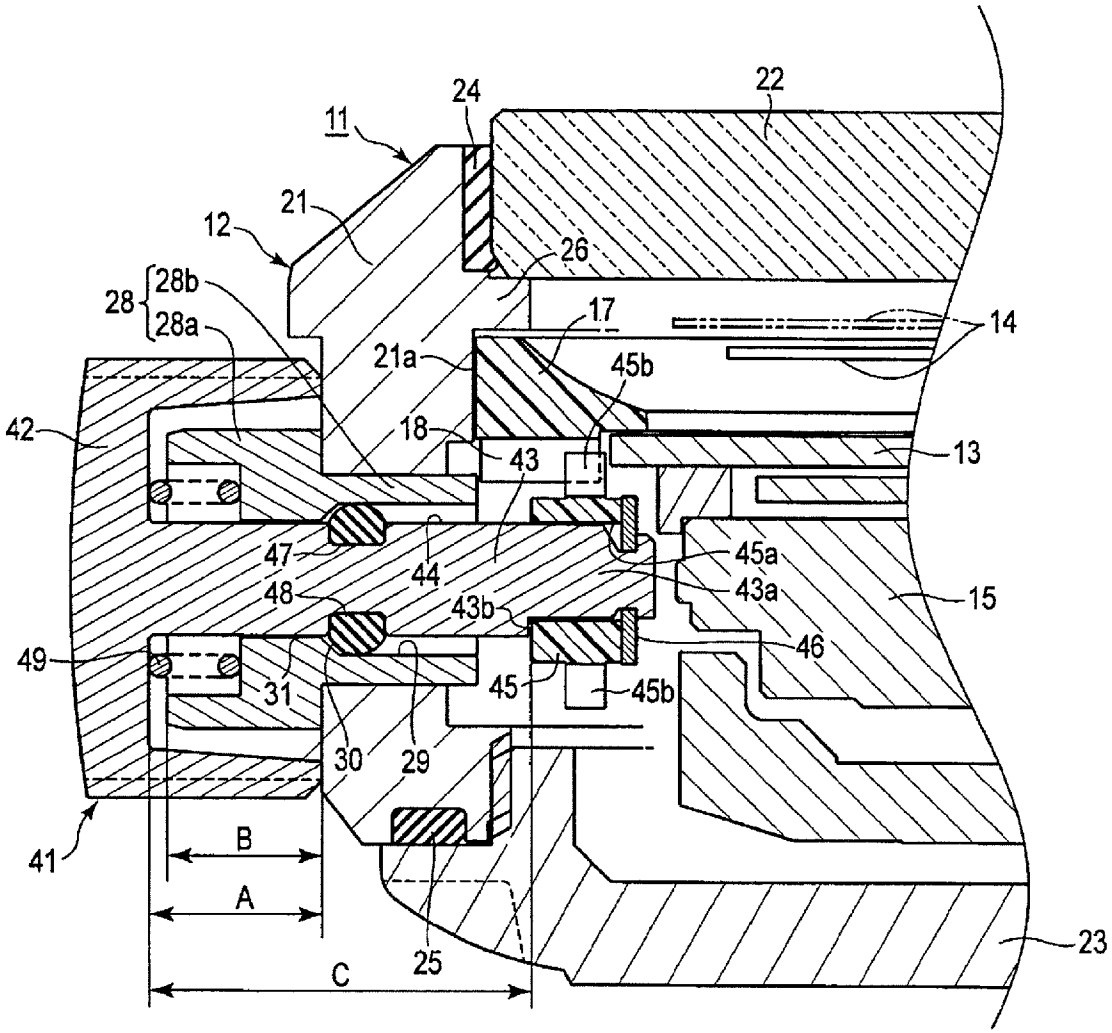
FIG. 7 is a sectional view corresponding to FIG. 6 showing a state in which the operation member of the wristwatch according to the second embodiment is arranged at the use position where it is operated.

FIGS. 5 through 7 show the second embodiment of the present invention. The timepiece according to the second embodiment is of the same construction as the first embodiment except for what is described below. Thus, the components that are of the same construction or of the same function as those of the timepiece of the first embodiment are indicated by the same reference numerals, and a description thereof will be left out.

The second embodiment differs from the first embodiment in the positions of the first annular contact surface 29 and the second annular contact surface 30 constituting the inner peripheral surface of the pipe 28.

That is, in the second embodiment, the first annular contact surface 29 is provided on the outer side of the case 12 with the annular slope 31 serving as a boundary. At the same time, the second annular contact surface 30 is provided on the inner side of the case with the annular slope 31 serving as a boundary. The inner diameter of the pipe 28 formed by the first annular contact surface 29 is smaller than the inner diameter of the pipe 28 formed by the second annular contact surface 30; conversely, the inner diameter of the pipe 28 formed by the second annular contact surface 30 is larger than the inner diameter of the pipe 28 formed by the first annular contact surface 29.

Further, in the second embodiment, there is provided an urging member such as a coil spring 49 urging the operation member 41 toward the exterior of the case 12. The coil spring 49 is held in a compressed state between the wall portion constituting the boundary between the large-diameter portion 28*a* and the small diameter portion 28*b* of the pipe 28 and the end wall of the head portion 42. The arrangement of the coil spring 49 is not restricted to that described above. For example, it is also possible to hold the coil spring 49 in a compressed state between the end surface of the pipe 28 opposite the end wall of the head portion 42 and the end wall of the head portion 42. Further, it is also possible to arrange the coil spring 49 so as to surround the outer periphery of the large-diameter portion 28*a* of the pipe 28, holding the coil spring 49 in a compressed state between the outer side surface 21*b* of the case band 21 and the end wall of the head portion 42.

Apart from the above-described construction, the present embodiment is the same at the first embodiment, including the construction not shown in FIGS. 5 through 7.

Next, the procedures for rotating the display body 17 in the second embodiment will be described.

First, in the state (shown in FIG. 6) in which the packing 48 is in contact with the first annular contact surface 29 constituting the inner peripheral surface of the small-diameter portion 28*b* of the pipe 28, the head portion 42 of the operation member 41 is pinched by the fingers, and the operation member 41 is pushed in toward the interior of the case 12 against the urging force of the coil spring 49, arranging the operation member 41 at the operating position as shown in FIG. 7. This pushing-in operation is stopped when the peripheral wall of the head portion 42 comes into contact with the outer side surface 21*b* of the case band 21.

Through this movement of the operation member 41, the packing 48 gets out of the narrow gap between the shaft portion 43 and the inner peripheral surface of the small-diameter portion 28*b*, and gets into the wide gap between the shaft portion 43 and the large-diameter portion 28*a* to come into contact with the second annular contact surface 30. That is, as it gets off the first annular contact surface 29, the packing 48 is increased in diameter due to the elastic force, and comes into contact with the second annular contact surface 30 constituting the inner peripheral surface of the large-diameter portion 28*a* of the pipe 28. As a result, there is attained a state in which the interference of the packing 48 is small.

With the operation member 41 being thus arranged at the operating position, the packing 48 maintains the elastic deformation, so that the waterproof performance between the pipe 28 and the shaft portion 43 is secured.

In this state, the shaft portion 43 is rotated together with the head portion 42, whereby the drive gear 45 is rotated integrally with the shaft portion 43. At the same time, the rotation of the drive gear 45 is transmitted to the display body 17 via the mesh-engagement of the display body 17 with the driven gear portion 18. Thus, the display body 17 is rotated in conjunction with the rotation of the operation member 41, so that it is possible to move the display 17*a* thereof to a desired position.

As described above, in the state in which the operation member 41 is pushed in to be arranged at the operating position, the packing 48 is increased in diameter. As compared with the state in which the packing 48 is in contact with the first annular contact surface 29 to be reduced in diameter as shown in FIG. 6, the elastic deformation of the packing 48 in this state is weakened. As a result, the contact force between the packing 48 and the second annular contact surface 30 is low, and the frictional engagement force therebetween is small. The frictional engagement force is a resistance force to the rotation of the operation member 41. Thus, it is possible to lightly rotate the operation member 41 in the state in which it is arranged at the operating state.

After the display body 17 has been rotated as desired, the operation member 41 is moved toward the exterior of the case 12, and is moved from the operating position to the setting position shown in FIG. 6.

Through this movement of the operation member 41, the packing 48 gets out of the wide gap between the shaft portion 43 and the large diameter portion 28*a*, and gets into the narrow gap between the shaft portion 43 and the inner peripheral surface of the small-diameter portion 28*b* to come into contact with the first annular contact surface 29. That is, as it gets off the second annular contact surface 30, the packing 48 is reduced in diameter by the annular slope 31, and, in this state, comes into contact with the first annular contact surface 29 constituting the inner peripheral surface of the small-diameter portion 28*b* of the pipe 28. As a result, there is attained a state in which the interference of the packing 48 is large. Through the contact of the packing 48 with the first annular contact surface 29, the waterproof performance between the pipe 28 and the shaft portion 43 is secured.

As described above, in the state in which the operation member 41 is arranged at the setting position, the packing 48 is reduced in diameter. As compared with the state in which the packing 48 is held in contact with the second annular contact surface 30 to be increased in diameter as shown in FIG. 7, the elastic deformation of the packing 48 in this state is enhanced. As a result, the contact force between the packing 48 and the first annular contact surface 29 is strong, and the frictional engagement force therebetween is large. Thus, a high waterproof performance is secured between the pipe 28 and the shaft portion 43. At the same time, as a large resistance force to the rotation of the operation member 41 is secured, it is possible to suppress the malfunction in which the operation member 41 is inadvertently rotated to rotate the display body 17.

As result of the reduction in the diameter of the packing 48, the resistance to the movement of the operation member 41 to the setting position increases. This resistance feel is sensed by the fingers, whereby it is possible to know whether or not the operation member 41 has been pulled to the setting position.

The side surface of the drive gear 45 is opposite the distal end of the small-diameter portion 28*b* of the pipe 28. As a result, when an attempt is made to excessively pull the operation member 41, the drive gear 45 gets caught by the distal end of the small-diameter portion 28*b*, and the pipe 28 serves as a stopper. As a result, the shaft portion 43 of the operation member 41 is drawn out of the pipe 28, and the operation member 41 is not detached from the case 12.

The first annular contact surface 29 and the second annular contact surface 30 form no step, and are continuous with each other via the annular slope 31. Thus, the reduction in the diameter of the packing 48 accompanying the pulling of the operation member 41 is effected smoothly, and there is no fear of the packing 48 being scraped by the step to generate refuse. At the same time, as described above, the frictional engagement force between the second annular contact surface 30 and the packing 48 is weak, so that it is possible to reduce the wear of the packing 48 when rotating the display body 17. Thus, the durability of the packing 48 is improved.

Further, as described above, the packing 48 does not easily involve generation of cutting refuse and wear refuse. Thus, it is possible to prevent deterioration in waterproofing due to such refuse being got caught between the pipe 28 and the packing 48.

As described above, according to the second embodiment, although it is possible to suppress a malfunction of the display body 17 in the case 12, it is possible to lightly operate the operation member 41 conjunction-moving the display body 17, and to provide the wristwatch 11 which is of high reliability in terms of waterproofing around the operation member 41.

In addition, the timepiece 11 according to the second embodiment is equipped with a coil spring 49 urging the operation member 41 toward the exterior of the case 12. Thus, when there ceases to exist the pushing-in force with respect to the operation member 41 pushed in to the operating position so as to reduce the interference of the packing 48, the operation member 41 is automatically pushed back toward the exterior of the case 12 due to the urging force of the coil spring 49 without having to specially perform the operation of pulling the operation member 41. As a result, the operation member 41 is arranged at the setting position so as to increase the interference of the packing 48, so that it is possible to suppress inadvertent rotation of the operation member 41 when, for example, the timepiece 11 is being carried about.

Figure 8:
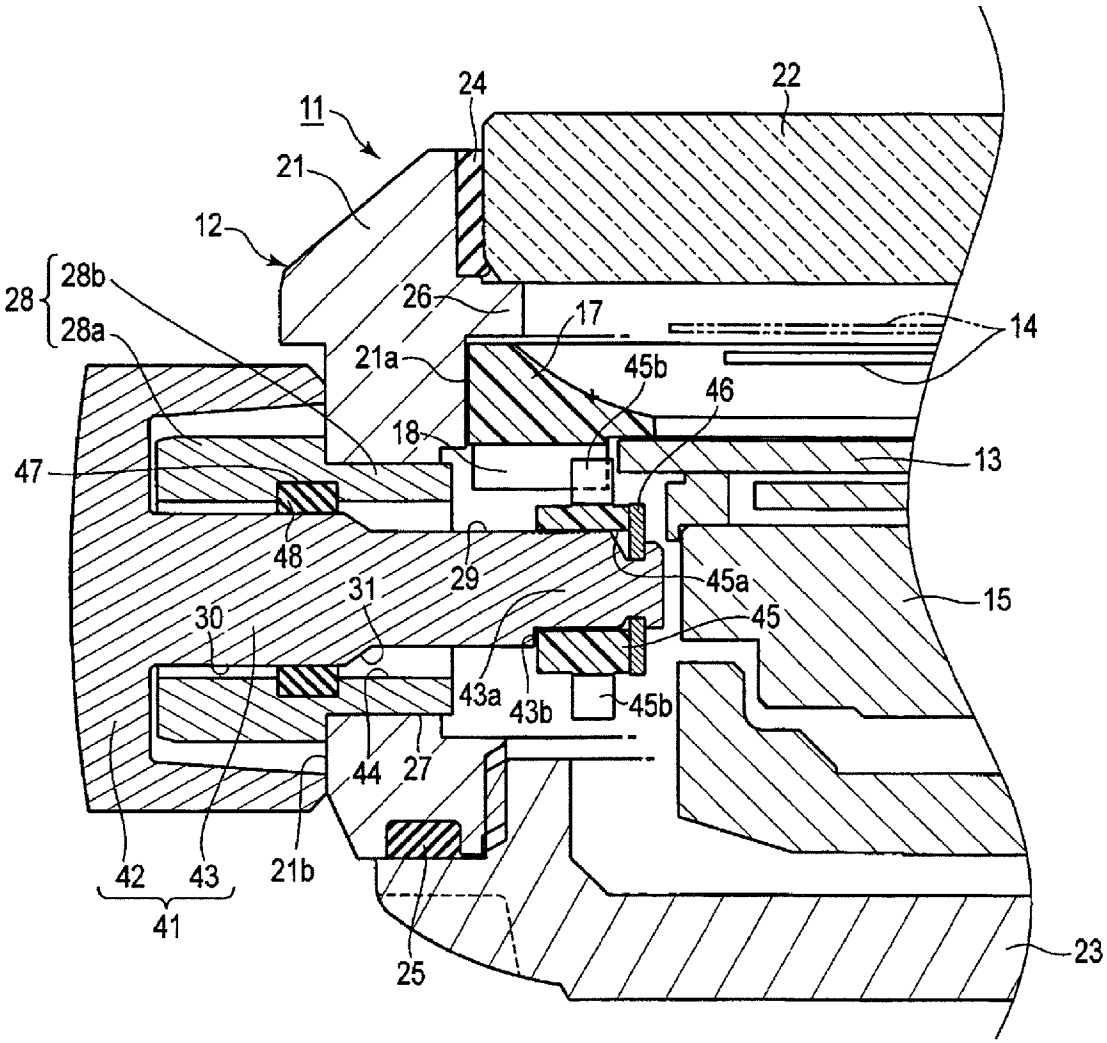
FIG. 8 is a sectional view corresponding to claim 2 showing a wristwatch according to a third embodiment of the present invention.

FIG. 8 shows the third embodiment of the present invention. The timepiece according to the third embodiment is of the same construction as the first embodiment except for what is described below. Thus, the components that are of the same construction or the same function as those of the timepiece of the first embodiment are indicated by the same reference numerals, and a description thereof will be left out.

In the third embodiment, the arrangement of the first annular contact surface 29, the second annular contact surface 30, and the annular slope 31, the arrangement of the annular opposing surface 44 opposite these surfaces, and the arrangement of the mounting groove 47 and the packing 48 are different from those of the first embodiment.

That is, the first annular contact surface 29, the second annular contact surface 30, and the annular slope 31 extending between these contact surfaces are provided on the shaft portion 43 of the operation member 41. These surfaces constitute at least a part of the outer peripheral surface of the shaft portion 43.

The diameter of the shaft portion 43 formed by the second annular contact surface 30 is larger than the diameter of the shaft portion 43 formed by the first annular contact surface 29. The first annular contact surface 29 is provided on the distal end side of the shaft portion 43, that is, on the inner side of the case 12, with the annular slope 31 serving as a boundary; conversely, the second annular contact surface 30 is provided on the proximal end side of the shaft portion 43, that is, on the outer side of the case 12, with the annular slope 31 serving as a boundary.

The annular opposing surface 44 constitutes at least a part of the inner peripheral surface of the pipe 28, and is provided on the pipe 28. The diameter formed by this annular opposing surface 44 (the inner diameter of the pipe 28) involves no change, and is fixed. Thus, a narrow gap is formed between the first annular contact surface 29 and the annular opposing surface 44 by the pipe 28 and the shaft portion 43 inserted into the same, and a gap wider than this gap is formed between the first annular contact surface 29 and the annular opposing surface 44. It is desirable for the inner diameter of the pipe 28 constituting the annular opposing surface 44 to be fixed from the viewpoint of machining this surface; however, the diameter of the annular opposing surface 44 may be different with the packing 48 described below serving as a boundary so long as the condition of securing the gap relationship is satisfied.

A mounting groove 47 is formed in the pipe 28. The packing 48 is fit-engaged with the mounting groove 47, and is mounted to the pipe 28 so as to protrude from the annular opposing surface 44. This packing 48 is held between the pipe 28 and the shaft portion 43, and is elastically deformed in a compressed state, serving to effect waterproofing between the pipe 28 and the shaft portion 43.

The construction other than what has been described above, including the construction not shown in FIG. 8, is the same as that of the first embodiment.

In the third embodiment, to rotate the display body 17, the head portion of the operation member 41 is first pinched, and the operation member 41 is pulled toward the exterior of the case 12 from the state shown in FIG. 8 to be arranged at the operating position. Next, in this state, the operation member 41 is rotated, whereby it is possible to rotate the display body 17 in the case 12 in conjunction therewith. In this case, as the operation member 41 is pulled, the position of the shaft portion 43 with respect to the annular opposing surface 44 and the packing 48 is changed.

More specifically, the second annular contact surface 30 is detached from the packing 48, and the first annular contact surface 29 is brought into contact with the packing 48. As a result, the packing 48 is increased in diameter, and is positioned in the wide gap between the first annular contact surface 29 and the annular opposing surface 44, and, at the same time, is brought into contact with the first annular contact surface 29. As a result, a waterproofing property is secured between the pipe 28 and the shaft portion 43. In the state in which the packing 48 is thus increased in diameter, the frictional engagement force between the packing 48 and the first annular contact surface 29 is weak. Thus, it is possible to rotate the operation member 41 with a slight force at the operating position, where the display body 17 is conjunction-moved.

After the display body 17 is rotated, the operation member 41, which has already been pulled, is pushed in toward the interior of the case 12, and is arranged at the setting position. As the operation member 41 is pushed in, the relative position of the shaft portion 43 with respect to the annular opposing surface 44 and the packing 48 is changed.

More specifically, the first annular contact surface 29 is detached from the packing 48, and the second annular contact surface 30 comes into contact with the packing 48. As a result, the packing 48 is reduced in diameter, and positioned in the narrow gap between the second annular contact surface 30 and the annular opposing surface 44, and, at the same time, is brought into contact with the second annular contact surface 30. As a result, a waterproofing property is secured between the pipe 28 and the shaft portion 43.

In the state in which the operation member 41 is thus arranged at the setting position, the frictional engagement force between the packing 48 and the second annular contact surface 30 is strong. Thus, the waterproof performance around the operation member 41 is high. At the same time, it is possible to effectively suppress inadvertent rotation of the operation member 41, and, with that, it is possible to prevent danger of the display body 17 being erroneously rotated.

Further, as described above, the contact pressure of the packing 48 with respect to the first annular contact surface 29 at the operating position is weak, so that it is possible to suppress wear of the packing 48 accompanying the rotation of the operation member 41. At the same time, when pushing in the operation member 41 from the operating position to the setting position, it is possible to smoothly reduce the diameter of the packing 48 in the increased-diameter state without scraping it with the annular slope 31. Thus, it is possible to suppress deterioration in waterproof performance due to wear refuse and cutting refuse of the packing 48.

As described above, according to the third embodiment, although it is possible to suppress a malfunction of the display body 17 in the case 12, it is possible to provide the wristwatch 11 in which it is possible to lightly operate the operation member 41 moving the display body 17 in conjunction therewith, and which is of high reliability in terms of waterproofing around the operation member 41.

The above-described third embodiment is also applicable to a timepiece in which, as in the second embodiment, the display body 17 is conjunction-moved by rotating the operation member 41 in the state in which it has been pushed in to the operating position, and in which, from this state, the operation member 41 is pulled to the exterior of the case 12 to move it to the setting position.

In this case, the first annular contact surface 29 is provided at the proximal side with respect to the shaft portion 43 with the annular slope 31 serving as a boundary, that is, on the outer side of the case 12, and the second annular contact surface 30 is provided at the distal end side with respect to the shaft portion 43 with the annular slope 31 serving as a boundary, that is, on the inner side of the case 12.

What is claimed is:

1. A timepiece comprising:

a case having a through-hole formed therein in a first direction;

a display body having a display and accommodated in the case so that the display can rotate in the case;

a pipe fixed in the through-hole;

an operation member having a head arranged outside the case for rotational operation, and a shaft being inserted in the pipe for rotation, the shaft having an inner end portion protruding out from an inner end of the pipe towards inside the case in the first direction, the shaft being movable in the pipe in the first direction to position the operation member relative to the pipe between a first position and a second position located at a location different from the first position in the first direction;

a drive mechanism attached to the inner end portion of the shaft and operably connected to the display to rotate the display by operation of the operation member;

first and second contact sections formed along the first direction by an inner peripheral surface of the pipe and an outer peripheral surface of the shaft, a first gap formed in the first contact section between the inner peripheral surface of the pipe and the outer peripheral surface of the shaft being narrower than a second gap formed in the second contact section between the inner peripheral surface of the pipe and the outer peripheral surface of the shaft; and a ring-like packing pressed between the inner peripheral surface of the pipe and the outer peripheral surface of the shaft portion and selectively positionable in the first contact section or the second contact section as the operation member moves in the first direction between the first and second positions, the ring-like packing being so sized that the ring-like packing effects waterproof between the pipe and the shaft in both first and second contact sections and that the ring-like packing is pressed harder in the first contact section than it is in the second contact section, wherein the ring-like packing when positioned in the first contact section exerts more friction on relative rotation between the pipe and shaft to cause rotation of the display by the operation member heavier than it does when positioned in the second contact section.

2. The timepiece according to claim 1, wherein the inner peripheral surface of the pipe comprises a first annular contact surface in the first contact section and a second annular contact surface in the second contact section, the second annular contact surface being larger than in diameter than the first annular contact surface, and the ring-like packing is mounted to the outer peripheral surface of the shaft.

3. The timepiece according to claim 2, wherein the first contact section is provided on an inner side of the case in the first direction than the second contact section.

4. The timepiece according to claim 2, wherein the first contact section is provided on an outer side of the case in the first direction than the second contact section.

5. The timepiece according to claim 4, further comprising an urging member urging the operation member toward outside the case.

6. The timepiece according to claim 1, wherein the outer peripheral surface of the shaft portion comprises a first annular contact surface in the first contact section and a second annular contact surface in the second contact section, the second annular contact surface being larger in diameter than the first annular contact surface, the packing is mounted to the inner peripheral surface of the pipe.

7. The timepiece according to claim 1, further comprising a disc-like dial accommodated in the case, and the display body is ring-like and arranged for rotation along an outer peripheral edge of the disc-like dial.

* * * * *